US007303215B2

(12) United States Patent
Moon et al.

(10) Patent No.: US 7,303,215 B2
(45) Date of Patent: Dec. 4, 2007

(54) MORTISE LOCKING DEVICE

(75) Inventors: Charles W. Moon, Colorado Springs, CO (US); Ernst Kern Mitchell, Sterling Heights, MI (US); Michael J. Wright, Santa Ana, CA (US)

(73) Assignee: Computerized Security Systems, Troy, MI (US)

( * ) Notice: Subject to any disclaimer, the term of this patent is extended or adjusted under 35 U.S.C. 154(b) by 163 days.

(21) Appl. No.: 11/046,934

(22) Filed: Jan. 31, 2005

(65) Prior Publication Data

US 2006/0087125 A1 Apr. 27, 2006

Related U.S. Application Data

(60) Provisional application No. 60/621,815, filed on Oct. 25, 2004.

(51) Int. Cl.
*E05C 1/00* (2006.01)
*E05C 1/12* (2006.01)

(52) U.S. Cl. ..... 292/32; 292/169; 292/169.14; 70/107

(58) Field of Classification Search ..... 292/32, 292/37, 137, 169, 169.14, 163, 333, DIG. 65; 70/107–111, 432–434, 450
See application file for complete search history.

(56) References Cited

U.S. PATENT DOCUMENTS 2,622,429 A * 12/1952 Lipiner ..... 70/93
3,148,525 A * 9/1964 Durant ..... 70/107
3,890,608 A * 6/1975 Peterson ..... 340/522
3,999,411 A * 12/1976 Kambic ..... 70/144
4,434,635 A * 3/1984 Borgato ..... 70/279.1
4,677,834 A * 7/1987 Hicks ..... 70/279.1
4,950,005 A * 8/1990 Cudd ..... 292/150
5,083,448 A * 1/1992 Karkkainen et al. ..... 70/277
5,339,662 A * 8/1994 Goldman ..... 70/277
5,666,830 A 9/1997 Litvin
5,820,177 A * 10/1998 Moon ..... 292/335
6,076,382 A 6/2000 Naganuma
6,120,071 A * 9/2000 Picard et al. ..... 292/165

(Continued)

FOREIGN PATENT DOCUMENTS

DE 195 46 466 1/1997

(Continued)

OTHER PUBLICATIONS

Partial European Search Report dated Jan. 26, 2007.

*Primary Examiner*—Carlos Lugo
(74) *Attorney, Agent, or Firm*—Carlson, Gaskey & Olds

(57) ABSTRACT

A lock assembly includes a single switch actuated by a cam for monitoring the position of a main bolt and an auxiliary bolt. The main bolt and the auxiliary bolt engage and move the cam between an actuated position and a released position. In the actuated position the cam actuates a switch. Actuation of the switch indicates that the auxiliary bolt is retracted and that the main bolt is extended into a locked position. The main bolt includes a tail that engages a portion of the cam to drive the cam to the actuated position. The switch will remain in the actuated condition when the auxiliary bolt is retracted and the main bolt is also retracted.

20 Claims, 8 Drawing Sheets

U.S. PATENT DOCUMENTS

| | | | | |
|---|---|---|---|---|
| 6,174,004 | B1 * | 1/2001 | Picard et al. | 292/165 |
| 6,302,456 | B1 * | 10/2001 | Errani | 292/332 |
| 6,581,423 | B2 * | 6/2003 | Lin | 70/107 |
| 6,681,607 | B2 * | 1/2004 | Geringer | 70/432 |
| 2004/0045330 | A1 * | 3/2004 | Moon et al. | 70/107 |

FOREIGN PATENT DOCUMENTS

| | | |
|---|---|---|
| JP | 2005-162053 | 6/2005 |
| WO | WO 02/46555 | 6/2002 |

* cited by examiner 10
11
12
13
14
15
21
24
25
27
29
30
36
42
50
56
60
62
64
66
68
70
74
76

10
11
12
13
14
15
21
24
25
27
29
30
36
42
50
56
60
62
64
66
68
70
74
76

10
11
12
13
14
15
21
24
25
27
29
30
36
42
50
56
60
62
64
66
68
70
74
76
78

MORTISE LOCKING DEVICE

The application claims priority to U.S. Provisional Application No. 60/621,815 which was filed on Oct. 25, 2004.

BACKGROUND OF THE INVENTION

This invention generally relates to a mortise door locking device. More particularly, this invention relates to a mortise door locking device including a sensing mechanism for detecting when a door is in an unsecured position.

A mortise door locking device normally includes a main bolt and an auxiliary bolt that are both extended when the door is fully open. When the door is closed, the main bolt extends through a strike plate into a doorframe to hold the door securely, while the auxiliary bolt is pressed inward into the door by the strike plate. Currently known devices use sensors that determine whether the door is closed by checking the position of the auxiliary bolt. The sensor assumes that the door is closed and secure if the auxiliary bolt is retracted.

During normal door operation, this is usually true; however, there are cases where the auxiliary bolt is retracted sufficiently for the sensor to assume the door is closed and secure even though it is actually ajar (i.e., in an unsecure position). For example, the weather-stripping may keep the door from reliably closing because the latch bolt does not reach the strike plate hole, where it would extend and lock the door. However, because the sensor relies on the auxiliary bolt to determine the state of the door, the auxiliary bolt may indicate that the door is closed even though the main bolt may be retracted.

Accordingly, it is desirable to design and develop a door latch that monitors a position of both the main and auxiliary latches.

SUMMARY OF THE INVENTION

This invention is a lock assembly including a single switch that responds to mechanical linkages within the lock assembly for monitoring the position of the main and auxiliary lock assemblies.

An example lock assembly according to this invention includes a main bolt, and an auxiliary bolt movable within a housing. The housing is mounted within a door as is known to workers skilled in the art. The bolts are movable from within the housing to an extended position to engage opening within the doorframe. The main bolt and the auxiliary bolt extend from the lock assembly and include features that engage a cam disposed within the housing. The cam disposed within the housing is pivoted between an actuated position and a released position. In the actuated position the cam actuates a switch. Actuation of the switch indicates that the auxiliary bolt is extended from the housing or the main bolt is retracted substantially within the housing.

The switch will remain in an actuated condition until the auxiliary bolt is retracted by abutment with the strike plate and the main bolt is fully extended into the doorframe.

During normal door operation, it is usually true that the auxiliary bolt is retracted sufficiently to release the switch to properly indicate a locked position. However, sensing only the position of the auxiliary bolt does not necessarily provide accurate information on the lock condition. In prior art locks it was possible to provide a false signal of a lock condition with the main bolt blocked or impeded by some structure or item.

The lock assembly of this invention includes a cam pivotal between an actuated position and a release position. In the actuated position the switch is in an on position. The on position indicates that the door is in an unsecured position. When the switch is released or off this is an indication that the lock and therefore the door is in a secured condition. The cam pivots between the actuated and released position responsive to movement of the auxiliary bolt. When the auxiliary bolt is extended, the cam is driven to the actuated position. Upon retraction of the auxiliary bolt toward the housing, the cam is moved to the released position. However, the cam is only moved to the released position if the main bolt is extended. The main bolt includes a tail portion that engages a portion of the cam to drive the cam to the actuated position when the main bolt moved toward the retracted position. The tail portion of the main bolt only engages the cam when retraced at least partially within the lock.

Accordingly, the latch assembly of this invention provides for the accurate and reliable sensing of lock condition with a single switch actuatable by both the main bolt and the auxiliary bolt.

These and other features of the present invention can be best understood from the following specification and drawings, the following of which is a brief description.

DETAILED DESCRIPTION OF THE PREFERRED EMBODIMENT

Figure 1:
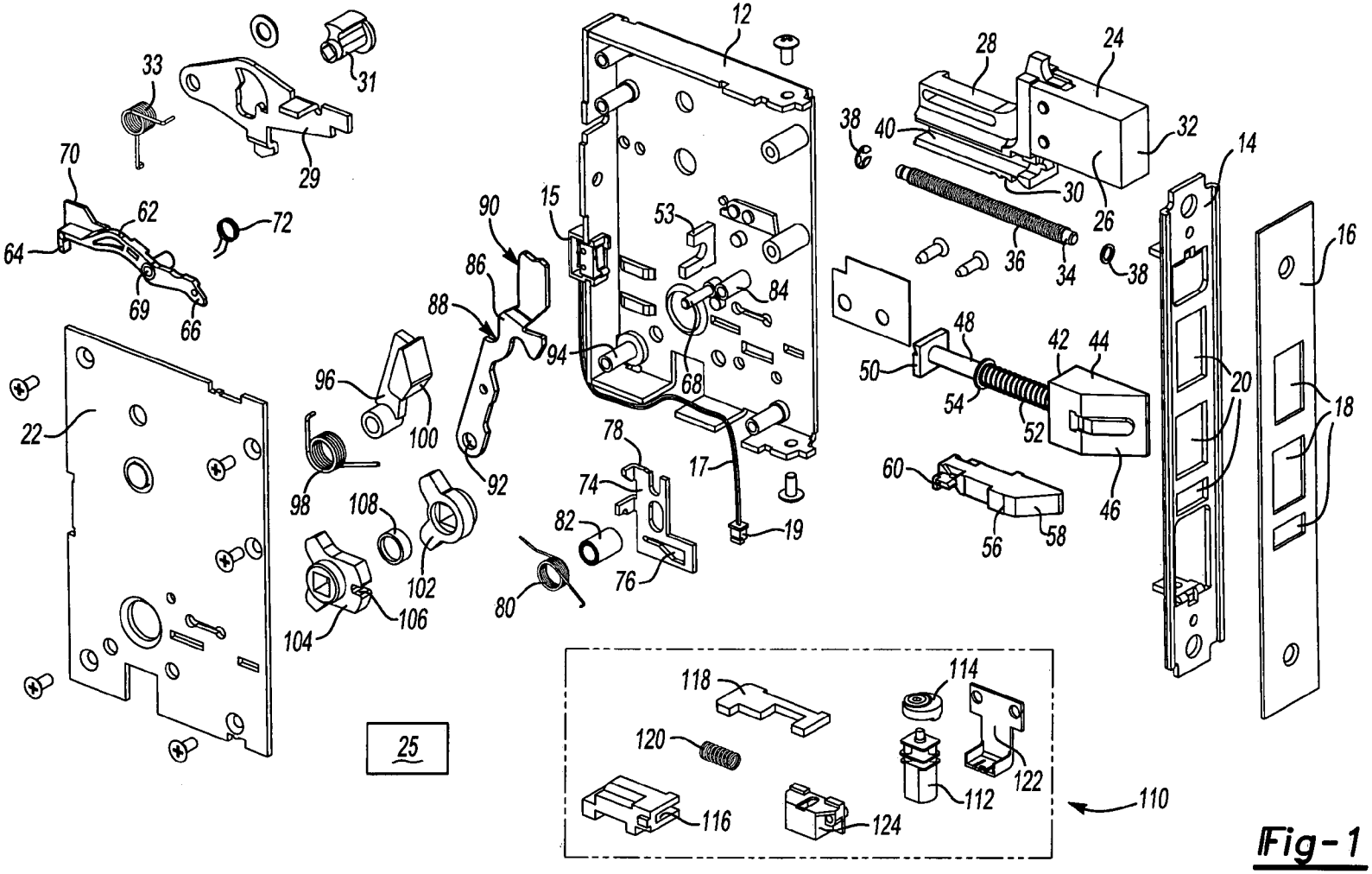
FIG. 1 is an exploded view of an embodiment of the locking device according to this invention.
Figure 2:
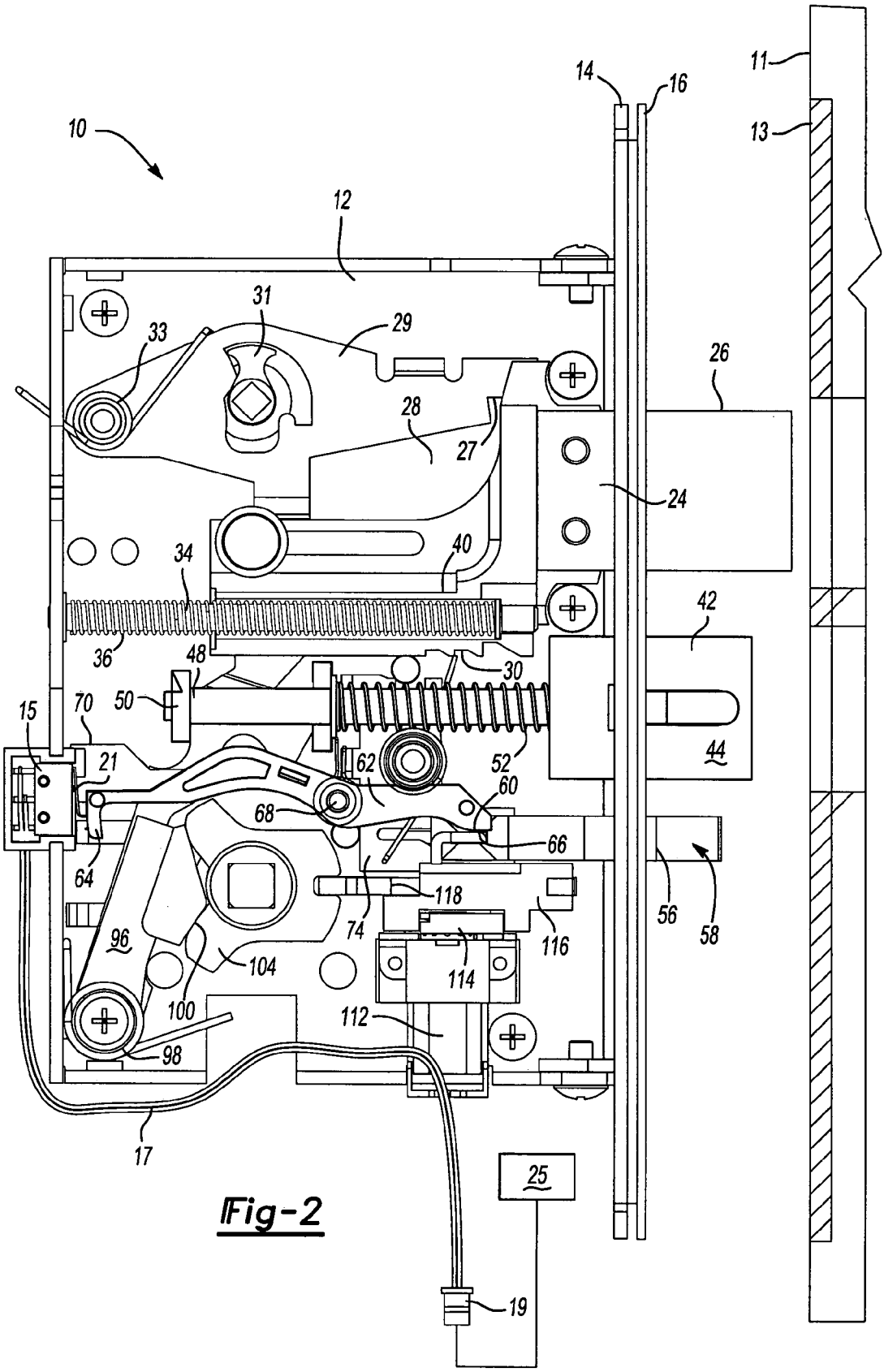
FIG. 2 is a cross-sectional view of the locking device according to this invention.

Referring to FIGS. 1 and 2, a lock assembly 10 includes a housing 12 having a front plate 14 and a cover plate 22. A scalp plate 16 is mounted outside the front plate 14. The scalp plate 16 and the front plate 14 each include respective openings 18, 20 for a deadbolt 24, a main bolt 42 and an auxiliary bolt 56. A switch 15 monitors a position of the main bolt 42 and the auxiliary bolt 56. A controller 25 monitors the state of the switch 15, and alerts of a state of the lock assembly 10 responsive to a condition of the switch 15. A cam 62 pivots responsive to a position of the main bolt 42 and the auxiliary bolt 56 to actuate the switch 15.

The lock assembly 10 includes an electric motor assembly 110. The electric motor assembly 110 includes a motor 112 that is mounted by way of a mount plate 122 and mount bracket 124. The motor 112 rotates a cam 114 within a cam block 116. The cam block 116 supports a lock plate 118 that is biased by a spring 120. The locking plate 118 engages a slot 106 of an exterior operating cam 104. A corresponding interior operating cam 102 is mounted co-axially with the exterior cam 104 and separated by a bushing 108.

Each of the operating cams 102 and 104 are actuated by door handles (not shown). The operating cams 102, 104 are biased towards a closed position by a biasing lever 96. The biasing lever 96 includes a face 100 that corresponds to a configuration of the operating cams 102, 104. The biasing lever 96 is biased towards the operating cams 102, 104 by a biasing spring 98. Rotation of either of the operating cams 102, 104 causes a pivotal movement of an operating lever 86. The operating lever 86 is pivotal about a pivot shaft 94 that also supports pivotal movement of the biasing lever 96. The pivot shaft 94 is cylindrical and extends from the housing 12. The pivot shaft 94 provides coaxial mounting of not only the operating lever 86 and biasing lever 96 but also the biasing spring 98.

The operating lever 86 engages a tail plate 50 of the main bolt 42. Engagement between the operating lever 86 and the tail plate 50 provides for opening and closing of the main bolt 42. The main bolt 42 is biased towards an extended position by a biasing spring 52 that is disposed along a shaft 48. The main bolt 42 includes the head portion 44 that extends from the housing 12 and the tail plate 50 that is disposed on the shaft 48 at the distal end from the head 44. The head 44 defines a face 46. The face 46 is preferably beveled as is known by a worker versed in the art to provide for the actuation and engagement of the main bolt 42 to the doorframe 11.

The auxiliary bolt 56 is moveable into and out of the housing 12 and is biased by a biasing spring 80 towards an extended position. The auxiliary bolt 56 includes a face portion 58 also beveled in a manner similar to the bevel of the main bolt 42. The auxiliary bolt 56 also includes a cam surface 60. The cam surface 60 is disposed on either side of auxiliary bolt 56. One surface engages a slot 76 that is disposed within a cam plate 74. The cam plate 74 is moveable in a direction transverse to movement of the auxiliary bolt 56. The other surface engages the cam 62.

The cam 62 is mounted on a pivot shaft 68 that is part of the housing 12. The cam 62 includes a switch flange 64 and a cam surface 66 that engages the cam surface 60 of the auxiliary bolt 56. The cam 62 pivots about the pivot shaft 68. The pivot shaft 68 is disposed between the switch flange 64 that is adjacent a first end and the cam surface 66 is adjacent a second end distal from the first end. A cam spring 72 biases the cam 62 towards a released position in which it does not engage the switch 15.

The cam 62 is pivotal between the actuated and the released position. In the actuated position the switch flange 64 engages a lever arm 21 of the switch 15. This closes the switch 15 and sends a signal through a wire 17 by way of a connector 19. The cam 62 is pivoted to the actuated position when the auxiliary bolt 56 is extended from the lock assembly 10.

The lock assembly 10 operates in a normal condition to automatically extend the deadbolt 24. This is accomplished by a biasing spring 36 disposed on a shaft 34 within a groove 40 of the deadbolt 24. Accordingly, the default condition of the deadbolt 24 is in an extended position. The deadbolt remains in the extended position until the operating cams 102 or 104 are rotated. When either of the operating cams 102,104 are rotated the operating lever 86 is pivoted to a rearward position that engages the deadbolt lever 29 and pivots it upward such that a catch 27 is disengaged from a body portion 28 of the deadbolt 24. By moving the catch 27 upward the body portion 28 is released and capable of moving to a retracted position within the housing 12.

Further, upon rotation of the operating cams 102, 104 the operating lever 86 engages the tail plate 50 of the main bolt 42. Engagement of the tail plate 50 provides for movement of the main bolt 42 to the retracted position. Movement of the main bolt 42 or deadbolt 24 does not affect the position of the auxiliary bolt 56. The position of the auxiliary bolt 56 is changed only by contact with the exterior strike plate 13 or other exterior elements that may engage the face 58 of the auxiliary bolt 56.

Figure 3:
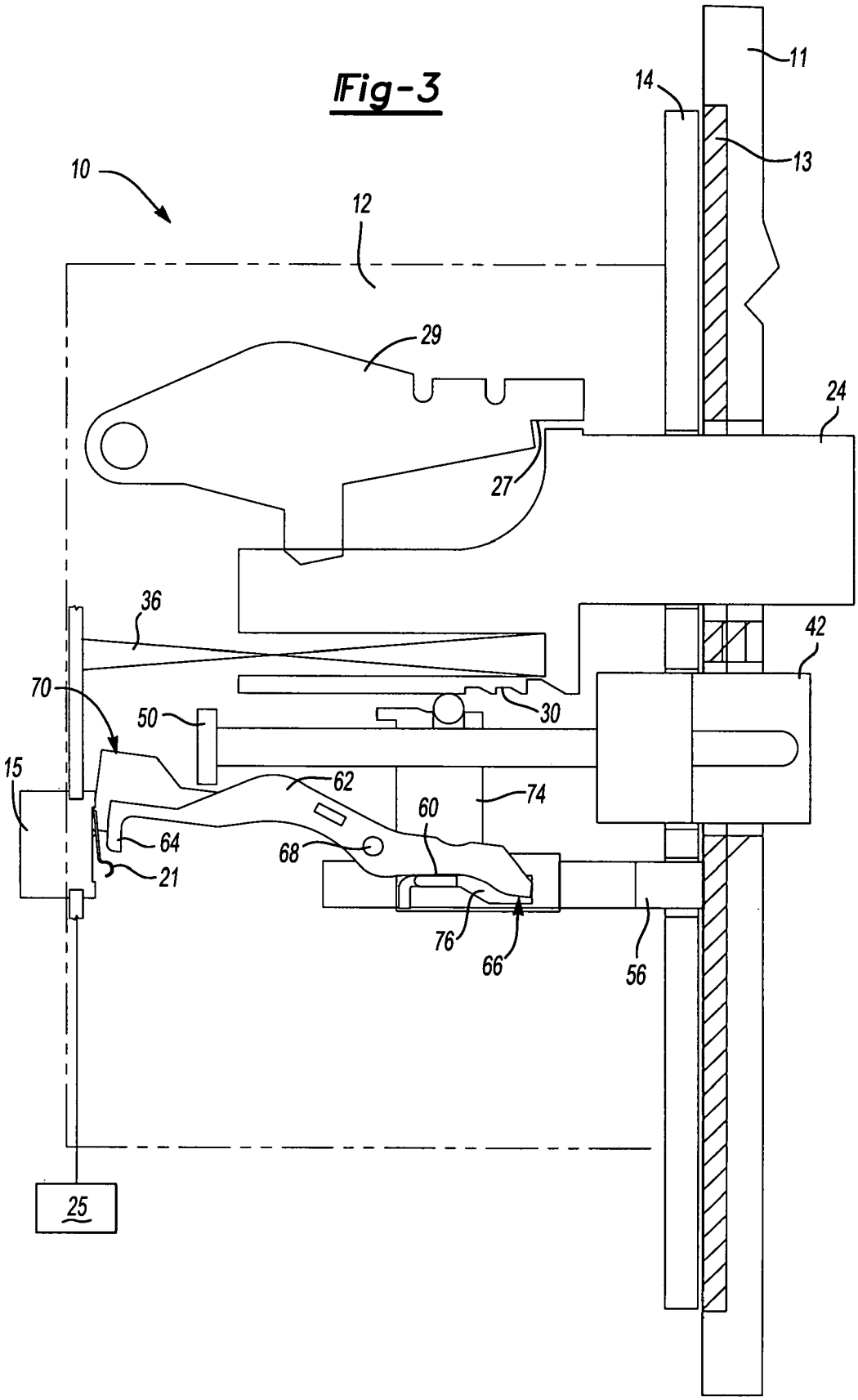
FIG. 3 is a schematic representation of the locking device according to this invention in a secure position.

Referring to FIG. 3, the lock assembly 10 is shown in a schematic view with several of the internal linkages and structures removed for clarity purposes. The deadbolt 24 and main bolt 42 extend into openings of the doorframe 11 and the strike plate 13. The auxiliary bolt 56 is in contact with the strike plate 13 and therefore is retracted into the housing 12. Upon retraction of the auxiliary bolt 56 into the housing 12 the cam surface 66 has disengaged the cam surface 60 of auxiliary bolt 56. Accordingly, the cam 62 rotates due to bias spring 80 to the default released position and releases the arm 21 of the switch 15. In this condition the switch 15 communicates that the lock assembly 10 is properly secured. The secured position includes the extension of both the main bolt 42 and the deadbolt 24. The switch 15 not only relays the position of the auxiliary bolt 56 but also the position of the main bolt 42.

Figure 4:
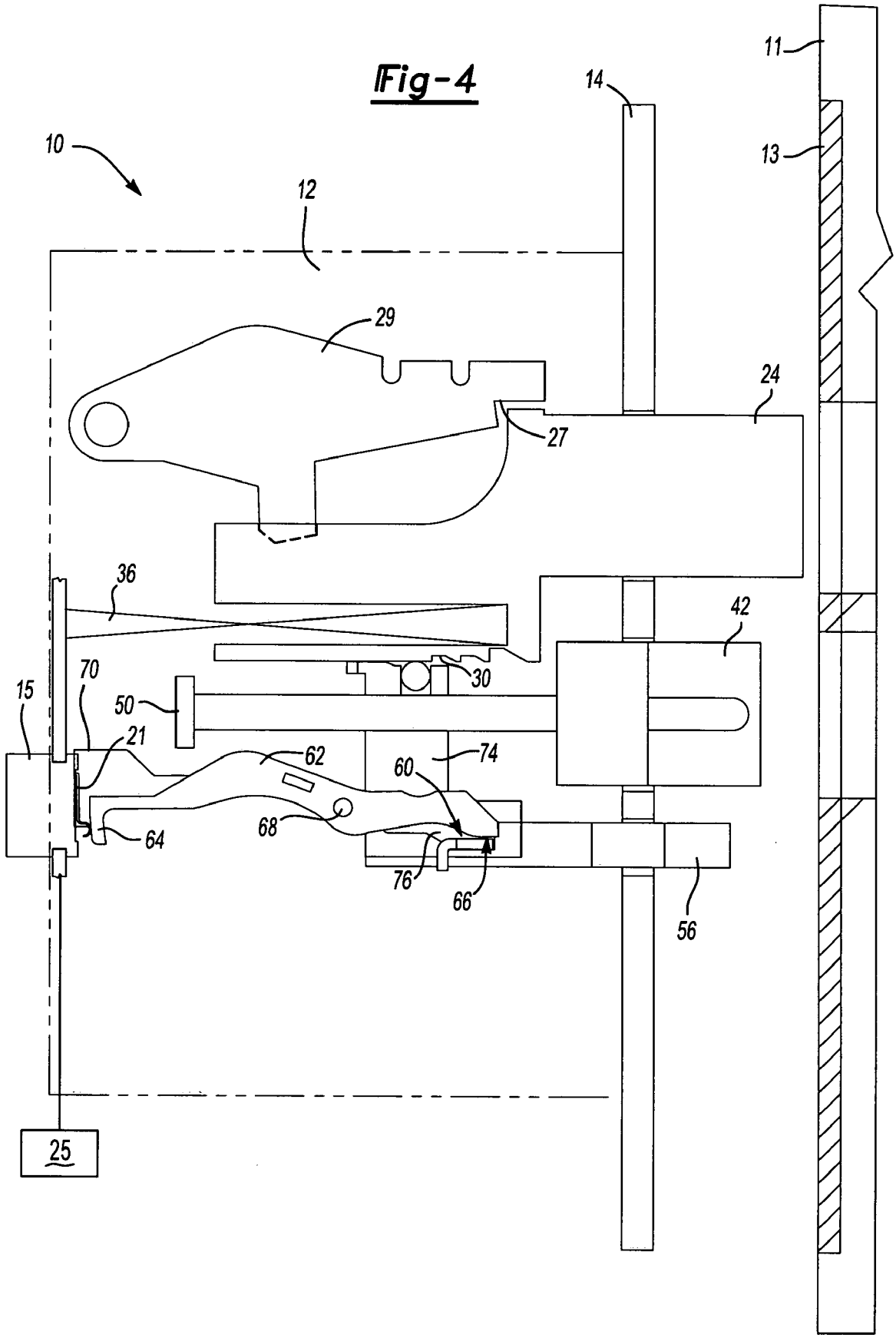
FIG. 4 is a schematic representation of the locking device in an unsecured position where each of the deadbolt, main bolt and auxiliary bolt are in an extended position.

FIG. 4 illustrates the lock assembly 10 in an opened, unsecured position with the auxiliary bolt 56, the main bolt 42 and the deadbolt 24 all in extended positions. With the auxiliary bolt 56 in an extended position, the cam surface 66 engages the cam surface 60 of the auxiliary bolt 56. Engagement of the cam surface 60 rotates the cam 62 about the pivot 68 to depress the arm 21 of the switch 15. The switch flange 64 engages the arm 21 to provide the desired switch actuation that indicates the unsecured position of the lock assembly 10. As appreciated, if the lock assembly 10 were in a locked position the auxiliary bolt 56 would necessarily be retracted. However, because the auxiliary bolt 56 is extended and not contacting the doorframe 11, the lock assembly 10 is in an open, unsecured position. Accordingly, the switch 15 registers this unsecured position and communicates that to the controller 25.

Figure 5:
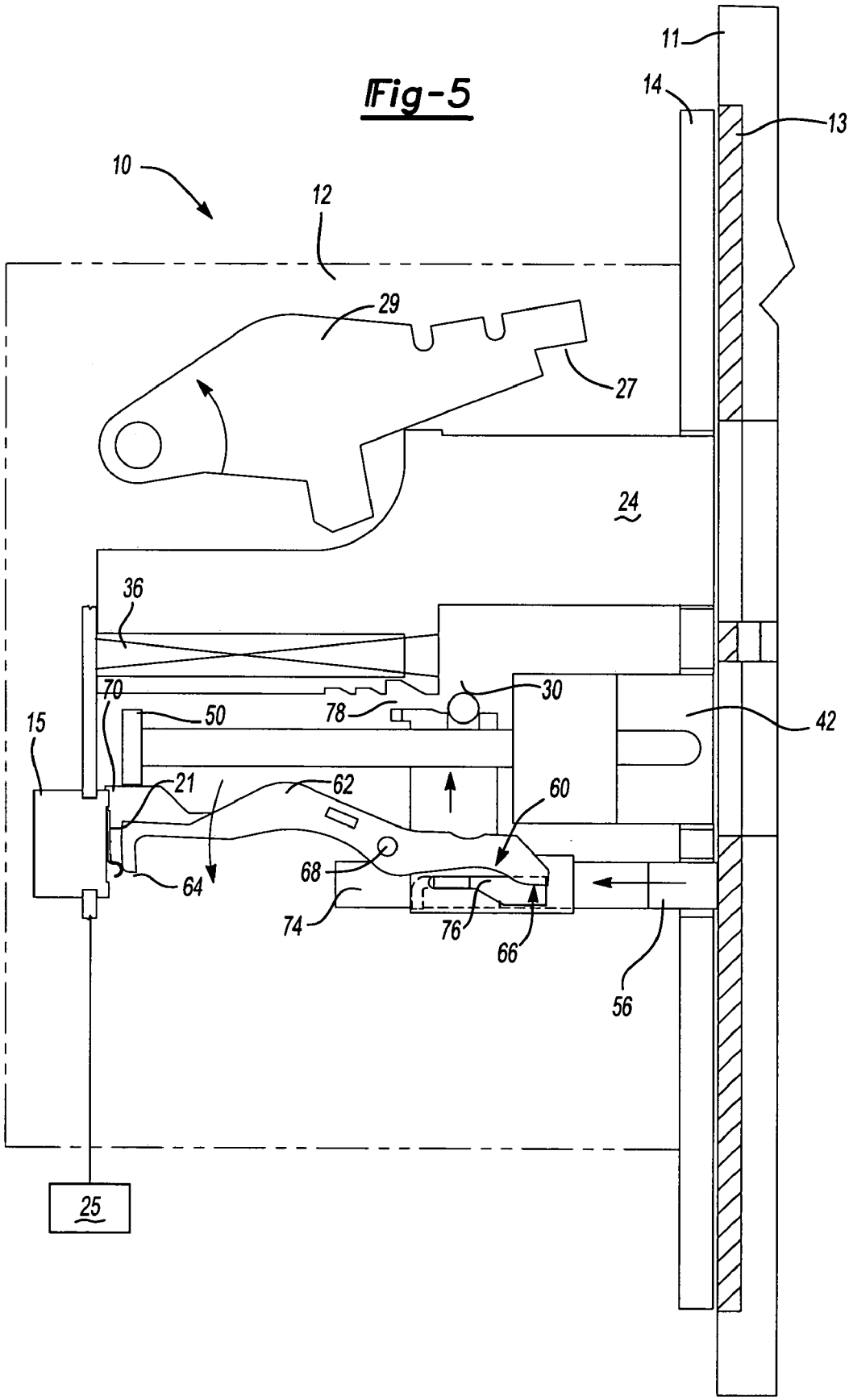
FIG. 5 is a schematic representation of the lock assembly in an unsecure position.

Referring to FIG. 5, another unsecured condition is illustrated where the auxiliary bolt 56 is retracted but the main bolt 42 is also retracted within he housing 12. The main bolt 42 may be retracted for many reasons, for example misalignment with openings in the strike plate 13, or an object covering or stuck into the opening in the strike plate 13. In this retracted position, the tail plate 50 engages a second cam surface 70 of the cam 62. Engagement between the second cam surface 70 and the tail plate 50 of the main bolt 42 inhibits rotation of the cam 62 to maintain actuation of the switch 15. Although, the auxiliary bolt 56 is retracted and therefore and the cam surface 60 is not engaged to the cam surface 66 of the cam 62, the switch remains actuated due to the position of the main bolt 42. The tail plate 50 engaging the cam 62 prevents movement to a released position that would indicate a secure condition of the lock 10 because the main bolt 42 is not allowed to extend from the lock assembly 10 due to a mis-aligned condition with the opening in the strike plate 13.

A cam plate 74 is slidable upwardly into engagement with locking groove 30 of the dead bolt 24. This prevents the deadbolt 24 from extending outwardly from the lock assembly 10 until the lock assembly 10 is in a proper secured position.

Figure 6:
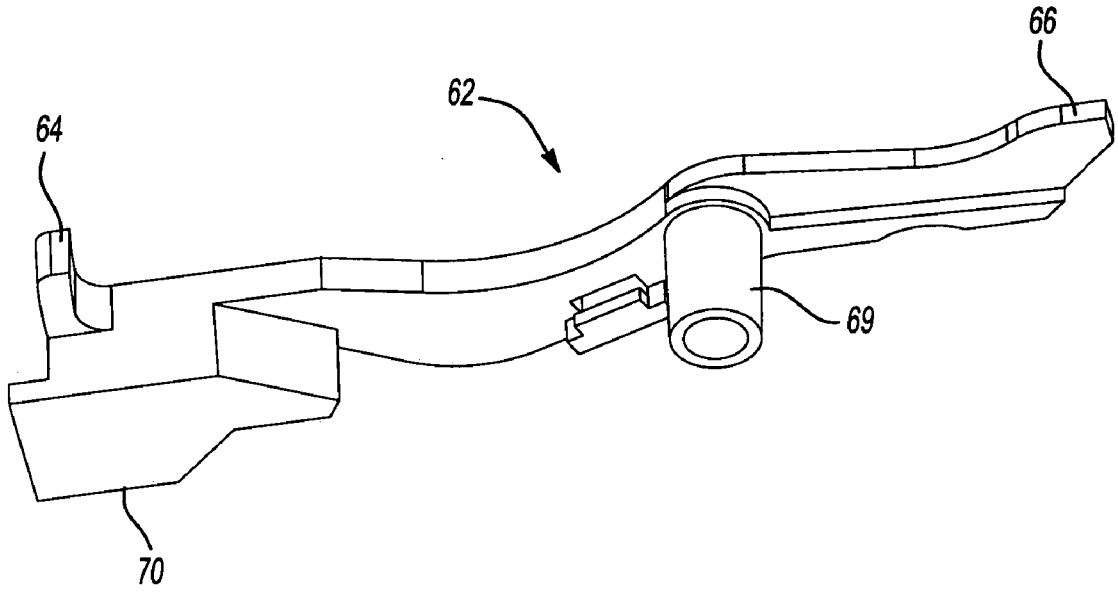
FIG. 6 is a perspective view of a bottom side of the cam assembly according to this invention.

Referring to FIG. 6, the cam 62 is shown in a perspective view that illustrates the pivot base 69 as a cylindrical boss that fits over the pivot shaft 68 of the housing 12. The cam surface 66 is a simple transitioned portion that rides on the cam surface 60 of the auxiliary bolt 56. The adjacent distal end of the cam 62 is the switch flange 64 that includes a rounded surface to engage the arm 21 of the switch 15. Adjacent this end is the second cam surface 70 that cooperates with the tail plate 50 of the main bolt 42. This cam surface 70 includes a ramped region that is engaged by the tail plate 50 to push the cam 62 and rotate it downwardly into the actuated position to engage the switch 15.

Figure 7:
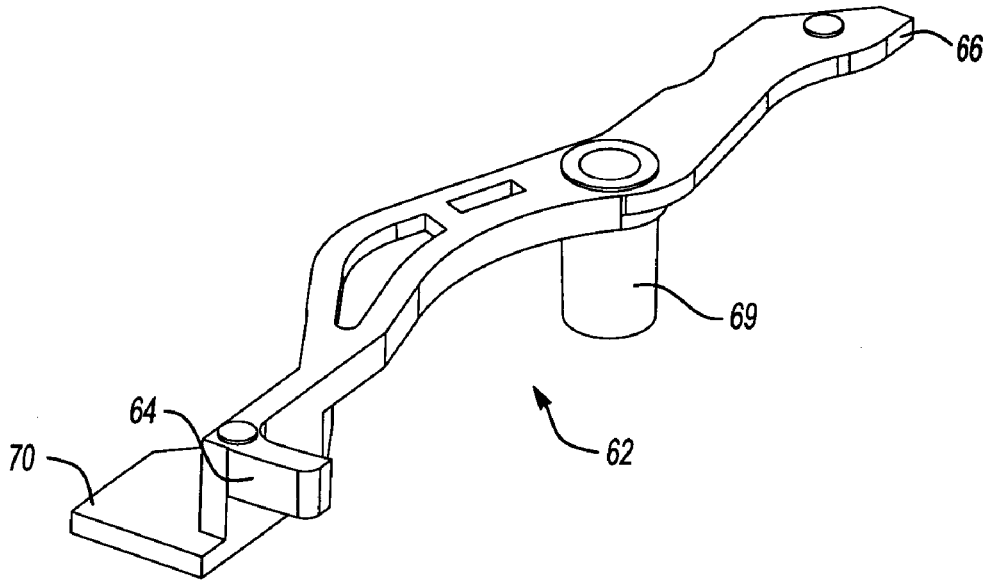
FIG. 7 is a top perspective view of the cam according to this invention.

FIG. 7 is a perspective view illustrating a top portion of the cam 62. This also shows another view of the pivot bass 69 and the cam surface 66. The cam 62 further includes the second cam surface 70 and the switch flange 64. Although, a specific configuration of the cam 62 is shown, other configurations that provide for and respond to movement of both the auxiliary bolt 56 and a main bolt 42 are within the contemplation of this invention. The cam 62 is a generally rectangular member including curved surfaces that correspond to desired actuation movements the lock assembly 10.

The cam 62 is preferably constructed from a plastic material that aids manufacturability of the complex shapes desired for providing specific cam actuation surfaces. Again, although plastic is preferred other material as may be know to one versed in the art are within the contemplation of this invention.

Figure 8:
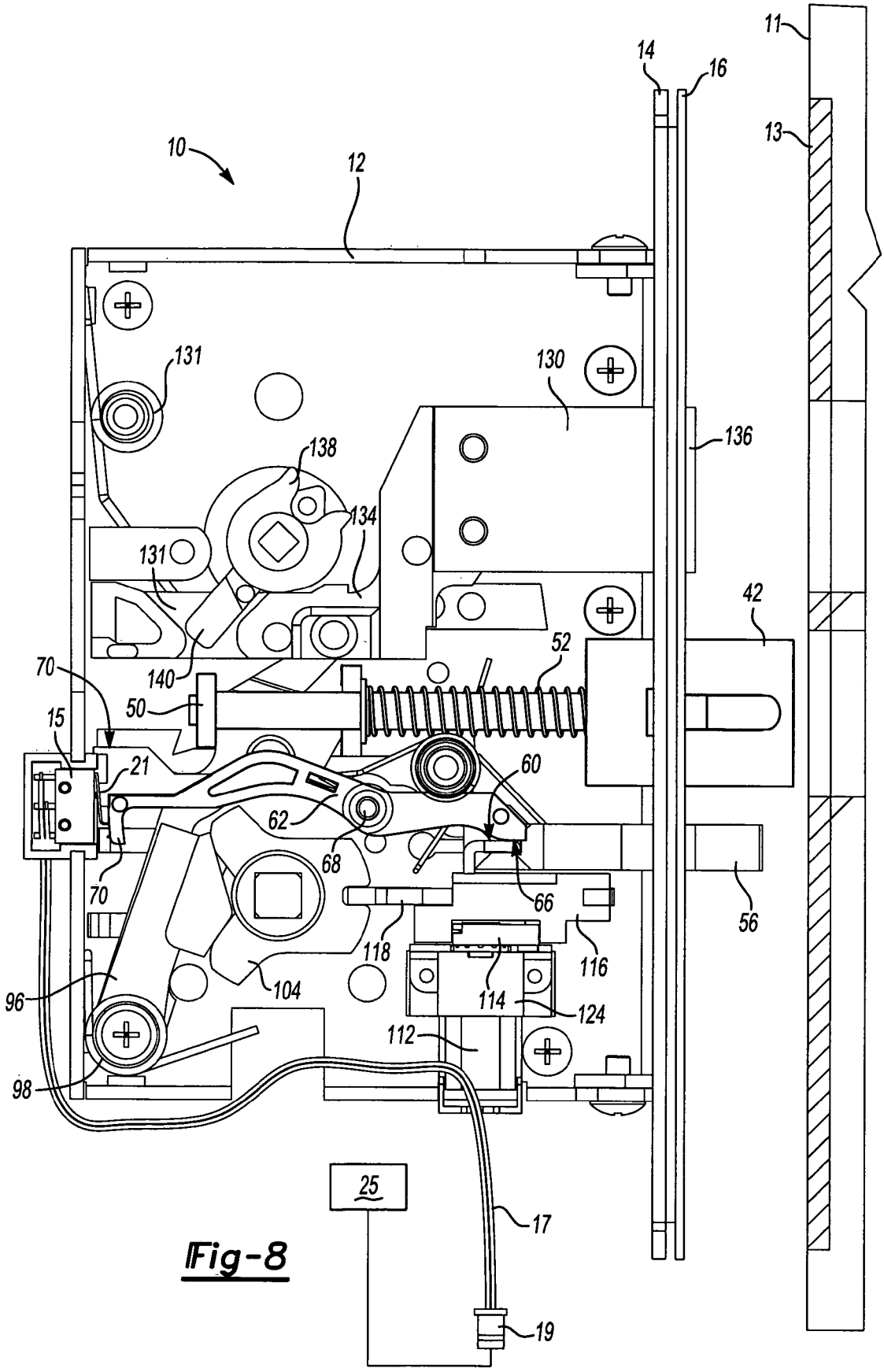
FIG. 8 is a side view of another embodiment of a locking device according to this invention.
Figure 9:
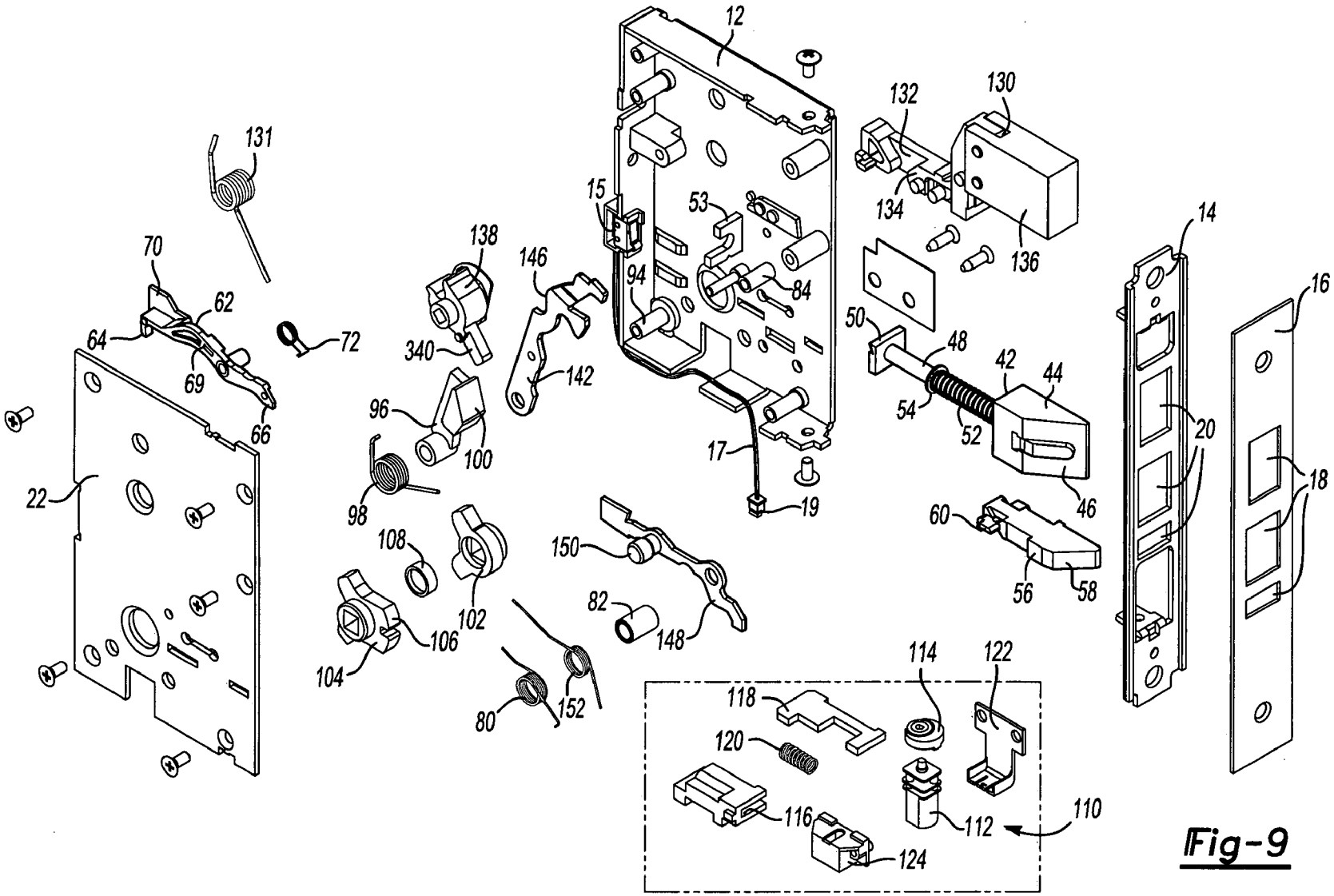
FIG. 9 is an exploded view of the embodiment shown in FIG. 8 of this invention.

Referring to FIGS. 8 and 9, another example latch assembly 129 according to this invention includes a deadbolt 130 having a body 134 that includes a cam slot 132 that establishes an engaging contact surface with a cam 138. The cam 138 is manually actuated such that the deadbolt 130 is extended only upon manual actuation of an external lever or handle. The deadbolt 130 operates independent of movement of the main bolt 42 it may fully extend fully only when the main bolt 42 is extended. However, the deadbolt 130 can be opened upon actuation of the operating cams 102 and 104 through an operating arm 140. The operating arm 140 is disposed within the cam slot 132 to move the deadbolt 130 upon actuation of the cam 138. The dead bolt 130 is only extendable when the main bolt 42 is in an extended position.

The lock assembly 129 includes four possible combinations of positions for the main bolt 42 and auxiliary bolt 56. A first condition includes the main bolt 42 and the auxiliary bolt 56 both retracted within the housing 12. If the main bolt 42 and the auxiliary bolt 56 are both retracted the switch 15 will remain engaged and indicate an unsecured condition. A second condition is where the main bolt 42 is retracted but the auxiliary bolt 56 is extended. In this condition a tail plate 50 of the main bolt 42 engages the second cam surface 70 of the cam 62 and holds the switch 15 in the actuated position. Further, extension of the auxiliary bolt 56 also causes the cam 62 to rotate to the actuated position. In a third position, the main bolt 42 and the auxiliary bolt 56 are extended and the switch 15 is held in an actuated position by the auxiliary bolt 56 engaging the cam surface 66. The fourth position includes a circumstance where the main bolt 42 is extended and the auxiliary bolt 56 is retracted. Accordingly, the switch 15 will be released to indicate a proper secured position of the lock assembly 129.

The switch 15 is preferably a single pull switch that responds to actuation by the cam 62 through the switch arm 21. The use of a simple single pull switch is unique in that the single switch is utilized to monitor several positions of both the auxiliary bolt 56 and the main bolt 42.

A door bolt control is incorporated into the device and provides for the deadbolt 136 to automatically engage the doorframe 11 when the auxiliary bolt 56 is retracted. The lock assembly 129 may also be used in an overall door monitoring system that detects when the switch 15 is actuated. The switch 15 communicates with the controller 25. The controller 25 may include either a local controller or a main controller that is in communication with several different door assemblies.

The controller 25 can be programmed to monitor the position of the switch 15 and to determine a specific condition and signal in response to expiration of a desired time period. The controller 25 can monitor the duration at which the switch 15 is actuated to indicate a secured position to provide a checking feature for lock assembly 129. Further, the controller 25 can be programmed to signal a warning upon the expiration of predetermined period of time to indicate an unsecured condition.

Accordingly, the lock assembly of this invention provides a simple effective means of accurately monitoring lock condition for example an egress, ingress or door ajar condition. The cam operated functioning of this lock assembly prevents and creates a more durable, manufacturable and economically desirable lock assembly.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A door latch assembly comprising:

a housing including a front plate having openings;

a main bolt and an auxiliary bolt both movable between an extended position extending outwardly past said front plate and a retracted position;

a cam movable in responsive to a position of both said auxiliary bolt and said main bold; and a switch actuatable by said cam in response to a position of said main bolt and said auxiliary bolt, wherein said cam moves between an actuation position where said cam actuates said switch and a release position where said cam does not actuate said switch and said cam is movable into said actuation position responsive to both said main bold and said auxiliary bolt being in said extended position; wherein said cam is not movable from said actuation position when said main bolt is in said retracted position.

2. The assembly as recited in claim 1, wherein said cam is movable toward said released position responsive to said main bolt being in said extended position and said auxiliary bolt being in said retracted position.

3. The assembly as recited in claim 1, wherein said switch is a single pole switch.

4. The assembly as recited in claim 1, including a dead bolt movable between an extended position outwardly past said faceplate and a retracted position.

5. The assembly as recited in claim 4, wherein said dead bolt moves automatically to said extended position responsive to said main bolt being in said extended position and said auxiliary bolt being in said retracted position.

6. The assembly as recited in claim 1, wherein said switch communicates a condition of said lock to a controller.

7. The assembly as recited in claim 6, wherein is said controller monitors a duration where the lock is an unsecured condition and triggers an alarm in response to said duration being greater than a predetermined duration.

8. The assembly as recited in claim 6, wherein said controller triggers a warning responsive to said switch indicated an unsecured condition.

9. A door latch assembly comprising:

a housing including a front plate having openings;

a main bolt and an auxiliary bolt both movable between an extended position extending outwardly past said front plate and a retracted position;

a cam movable in responsive to a position of both said auxiliary bolt and said main bold; and a switch actuatable by said cam in response to a position of said main bolt and said auxiliary bolt, wherein said cam moves between an actuation position where said cam actuates said switch and a release position where said cam does not actuate said switch and said cam is movable into said actuation position responsive to both said main bold and said auxiliary bolt being in said extended position, wherein said cam is not movable from said actuation position when said auxiliary bolt is said extended position.

10. A door latch assembly comprising:

a housing including a front plate having openings;

a main bolt and an auxiliary bolt both movable between an extended position extending outwardly past said front plate and a retracted position;

a cam movable in responsive to a position of both said auxiliary bolt and said main bold; and a switch actuatable by said cam in response to a position of said main bolt and said auxiliary bolt, wherein said cam moves between an actuation position where said cam actuates said switch and a release position where said cam does not actuate said switch and said cam is movable into said actuation position responsive to both said main bold and said auxiliary bolt being in said extended position, wherein said cam includes a cam surface adjacent a first end, a switch flange adjacent a second end and a pivot disposed between said first and second ends, said cam is biased toward said release position by a biasing member and pivotal about said pivot between said release and said actuation positions.

11. The assembly as recited in claim 10, wherein said auxiliary bolt includes an actuation surface engaged to said cam surface for moving said cam from said release position to said actuation position.

12. The assembly as recited in claim 10, wherein said main bolt includes a tail plate, said tail plate blocking movement of said cam toward said release position when said main bolt is in said retracted position.

13. The assembly as recited in claim 12, wherein said cam includes a second cam surface engageable with said tail plate of said main bolt, said tail plate engaging said second cam surface for moving said cam from said release position to said actuation position when said main bolt is moved toward said retracted position.

14. The assembly as recited in claim 10, wherein said switch includes a lever actuated by said switch flange of said cam.

15. A door latch assembly comprising:

a housing including a front plate having openings;

a main bolt and an auxiliary bolt both movable between an extended position extending outwardly past said front plate and a retracted position;

a cam movable in responsive to a position of both said auxiliary bolt and said main bold; and a switch actuatable by said cam in response to a position of said main bolt and said auxiliary bolt, a dead bolt movable between an extended position outwardly past said faceplate and a retracted position wherein said dead bolt moves automatically to said extended position responsive to said main bolt being in said extended position and said auxiliary bolt being in said retracted position, and wherein said dead bolt is lockable in said retracted position responsive to said auxiliary bolt being in said retracted position.

16. The assembly as recited in claim 15 including a cam plate movable between a first position locking said dead bolt and a second position releasing said dead bolt, said cam plate movable between said first and second positions by said auxiliary bolt.

17. A door lock assembly comprising:

a main bolt and an auxiliary bolt movable between a retracted position and an extended position;

a switch actuateable for determining a state of the lock assembly;

a cam including a first cam surface movable responsive to movement of said main bolt and a second cam surface movable responsive to movement of said auxiliary bolt wherein said cam actuates said switch for determining an unlocked state of said lock assembly when said main bolt and said auxiliary bolt are both in said extended position; and a pivot disposed between said first cam surface and said second cam surface for supporting pivotal rotation of said cam between an actuated position engaging the switch and a released position where said cam is not engaging said switch.

18. The assembly as recited in claim 17, wherein said lock assembly comprises one of a manually operated lock assembly and an automatically operated lock assembly.

19. The assembly as recited in claim 18, wherein said cam includes a switch flange for activating the switch.

20. The assembly as recited in claim 17, wherein said cam actuates said switch to indicate a locked state of said lock assembly when said main bolt is in said extended position and said auxiliary bolt is in said retracted position.

* * * * *

UNITED STATES PATENT AND TRADEMARK OFFICE

CERTIFICATE OF CORRECTION

PATENT NO. : 7,303,215 B2
APPLICATION NO. : 11/046934
DATED : December 4, 2007
INVENTOR(S) : Moon et al.

It is certified that error appears in the above-identified patent and that said Letters Patent is hereby corrected as shown below:

Claim 1, Column 6, line 38: “bold” should read as --bolt--

Claim 1, Column 6, line 45: “bold” should read as --bolt--

Claim 9, Column 7, line 10: “bold” should read as --bolt--

Claim 9, Column 7, line 17: “bold” should read as --bolt--

Claim 10, Column 7, line 27: “bold” should read as --bolt--

Claim 10, Column 7, line 34: “bold” should read as --bolt--

Claim 15, Column 8, line 10: “bold” should read as --bolt--

Signed and Sealed this

Thirteenth Day of May, 2008

JON W. DUDAS
*Director of the United States Patent and Trademark Office*